US005636761A

United States Patent [19]

Diamond et al.

[11] Patent Number: 5,636,761

[45] Date of Patent: Jun. 10, 1997

[54] DEFORMATION RESISTANT AEROSOL CONTAINER COVER

[75] Inventors: George B. Diamond, Glen Gardner; Ralph Helmrich, Asbury, both of N.J.

[73] Assignee: Dispensing Containers Corporation, Glen Gardner, N.J.

[21] Appl. No.: 543,315

[22] Filed: Oct. 16, 1995

[51] Int. Cl.[6] ..... B65D 8/06

[52] U.S. Cl. ..... 220/619; 220/623; 220/689

[58] Field of Search ..... 220/619, 620, 220/689

[56] References Cited

U.S. PATENT DOCUMENTS

| | | | |
|---|---|---|---|
| 700,576 | 5/1902 | Thompson | 220/619 |
| 2,426,550 | 8/1947 | Coyle | 220/619 |
| 3,525,455 | 8/1970 | Saunders | 220/619 |
| 4,775,071 | 10/1988 | Giggard | 220/619 |
| 4,813,576 | 3/1989 | Greenebaum II | 220/619 |

*Primary Examiner*—Joseph M. Moy
*Attorney, Agent, or Firm*—Ostrolenk, Faber, Gerb & Soffen, LLP

[57] ABSTRACT

For a pressurized container for dispensing a fluent material, and particularly an aerosol container, the cover or lid is domed, but is of sufficiently thin material that it might distort under elevated pressure in the container. To inhibit such distortion, one or both of the side walls of the cover recess, which is toward the periphery of the installed cover, are reinforced against deforming or stretching out of the container. In one embodiment, the radially inner wall of the recess engages the radially outer wall of the recess so that outward distortion of the dome of the cover is resisted by the stiffness of both engaged walls of the recess, strengthening the thin material domed cover against deformation under pressure in the container. Specifically, there may be annular ribs or other engageable deformations on walls of the recess that engage and thereby provide interference against the radially outer wall moving up out of the container upon the dome attempting to deform outwardly. In another embodiment, the radially outer and/or inner recess walls are stiffened by being corrugated. In still a further embodiment, the recess walls are partially angled and engage each other in the event deformation commences, and thereby effectively become a double wall construction resisting deformation.

22 Claims, 4 Drawing Sheets

DEFORMATION RESISTANT AEROSOL CONTAINER COVER

BACKGROUND OF THE INVENTION

The present invention relates to a pressurized fluent product dispensing container, particularly an aerosol container, and more particularly relates to the cover of the container, and specifically to a cover which resists deformation due to the internal pressure in the aerosol container.

Various fluent materials may be stored in a pressurized dispensing container having a cover with a dispensing nozzle for the fluent material. Various fluent materials, including pressurized gases, sprayable liquids under pressure, flowable liquids under pressure, liquids mixed with propellants and liquids under pressure within a container but not mixed with the propellant (in barrier pack containers, for example) are stored in a container and are dispensed through a nozzle supported in the cover of a pressurized container. The invention hereof is applicable to the cover on any type of pressurized container with a nozzle for dispensing fluent material. The invention is particularly described with reference to an aerosol container wherein a dispensable liquid is mixed with a volatile propellant in the container under pressure. Upon actuation of the container nozzle, a mixture of the volatile propellant, which exits the nozzle in liquid and/or gaseous form, and of the liquid contents of the container, which together with the expanding propellant forms a spray or a mist as it exits the nozzle under pressure, are dispensed through the container nozzle. In certain cases, the propellant does not mix with the liquid, but its pressure forces the liquid out and the propellant in gaseous form can also mix with the liquid in the nozzle, if the nozzle has a vapor tap.

The essential components of a typical aerosol spray container are the can or container which has an open top end, a cover or lid that is attached over the open end and a nozzle supported in the cover and communicating in the container for dispensing the container contents through the nozzle when the nozzle is actuated.

In order to dispense the contents of an aerosol spray container with sufficient force and to dispense the entire dispensable contents of the container, the conventional practice has been to increase the gas pressure of the propellant material in the container to a high enough level. Higher internal pressures require both the can walls and the cover to be sufficiently stiff and strong to contain the elevated pressure without deforming or bursting, especially under the stresses applied during shipping and handling and storage and particularly to withstand the elevated internal gas pressure developed in a heated environment, as could occur on a hot summer day in an unventilated storage location. The conventional way of strengthening the can and/or the cover on the can is to make it out of a stiff metal and usually also to make the can wall and the cover of thick enough material that it will neither deform nor burst under the elevated pressures that might be experienced under extreme heat or other unusual environmental conditions. However, thicker can walls and covers have several drawbacks. They are heavier in weight, more costly due to the quantity of materials to be used, more expensive to manufacture, and so stiff as to not be easily deformed or crushed for disposal or recycling. Further, transportation of heavier containers also requires more energy and is typically more expensive than transportation of lighter weight containers.

The inventors hereof recently made inventions which are contrary to the conventional practice, discussed above. Thy have developed a container having a thin walled body, which being cylindrical and seamless is very strong. This thin walled body is used in conjunction with a bottom which can be of much thicker wall construction, and is therefore also very strong. The propellant used in the container gives the container its rigidity, as well as acting as a propellant. Container rigidity is maintained with a very low residual pressure, i.e., after all the product has been dispensed. As a result, the wall of the container body could be made sufficiently thin enough that the unpressurized or emptied container could be crushed even by finger pressure. Such crushability was virtually unknown with prior aerosol dispensing containers. The inventors hereof use the internal pressure of the propellant and fluent material in the container to help maintain the undeformed shape of the container. But when the container is emptied of dispensable content, it can be crushed by finger pressure. This container concept is embodied both in an aerosol spray can in U.S. Pat. No. 5,211,317 and/or in a barrier type dispensing can in U.S. Pat. No. 4,171,757. Both patents are incorporated herein by reference for their teachings of thin walled, crushable cans, the benefits of thin walled cans and the environmental problems of thicker walled cans. However, even the thin walled cans have to this time been supplied with thicker, heavier covers to prevent the covers from deforming under the elevated pressures that may develop within the container.

A typical cover or lid for an aerosol container is not essentially flat or planar across the cover. In a cross section through a cover, it is crimped at its peripheral margin to the open end of the container; has a countersunk recess formed in the cover and projecting into the container and located adjacent the peripheral crimp; radially inward of the recess has a rounded, generally convex dome; and toward the center of the cover, the dome terminates at a stiffening rib where the dispensing nozzle penetrates through and is supported in the cover. The bottom of the countersunk recess in the cover is the weakest point in the cover and the most susceptible to deformation because of excessive pressure within the aerosol container.

If the metal or other material used for the cover of an aerosol container is too thin for the required pressures, the cover, which is already of a shape selected for strength, would deform and rise further out of the container, pulling up the metal from the outer side wall of the countersunk recess at the periphery of the cover and the cover would then be permanently deformed. When such deformation occurs, the outer side wall and bottom of the recess tend to unfold upwardly along with the rising cover until the recess is eliminated or substantially eliminated. A cover which deforms during testing or transportation is illegal, as well as being aesthetically unpleasant. Also, it may improperly position the nozzle with respect to the container and its contents and it may promote a leak from the container at the periphery of the cover.

Typically, the lid or cover of a container can usually cost as much money to make as the body of the container. It would be desirable to make the lid cheaper, for instance by making it as thin as possible for the particular pressures required. Further, a thinner cover is lighter in weight, and more easily deformed for discarding or recycling. If one of the inventors' thinned wall, easily deformed, recyclable containers were to have a stiff nondeformable cover, the disposability and recyclability of the container would be reduced. It is beneficial to have a lid or cover on the container with deformability similar to that of the container. In this manner, various governments' requirements can be met while maintaining low cost and desirable environmental properties.

SUMMARY OF THE INVENTION

It is an object of the invention to strengthen the lid or cover of a pressurized fluent material dispensing container, in particular an aerosol can.

A further object is to maintain adequate strength of the cover to prevent it from deforming under the pressures normally encountered in manufacture, transportation, storage and use of the pressurized container, and also comply with applicable laws and regulations.

Another object of the invention is to reduce the thickness of the cover from conventional thickness.

A further object is to enhance deformability, discardability and recyclability of the cover after the container contents have been dispensed.

The invention uses the radial sidewalls of the countersunk recess or depression which is around the periphery of the cover or lid radially just inward of the attachment, typically by double seaming of the periphery of the cover to the top end of the container. That recess is defined by two facing, opposed and in some cases slightly spaced apart surfaces of the lid material disposed at the radially opposite sides of the countersunk recess defining radially outward and radially inward side walls of the recess. When the cover dome deforms outwardly due to elevated pressure in the container, the radially outer wall of the recess moves up with the dome which also pulls up the bottom of the recess and the radially inner wall, thereby shortening the depth of the recess possibly until the recess is eliminated, and the radial outer and inner walls and the base of the recess become part of the generally spherical cover.

The invention comprises means at or in the recess of the cover which prevent or at least inhibit the radially outer and inner side walls of the recess from rising and thereby allowing the cover to rise.

In preferred embodiments, means engage the two radially opposed side walls of the recess to one another so that the outer wall cannot move up without attempting to drag the inner wall upward. This produces an effectively double thickness wall in the recess which prevents or inhibits the outer wall of the recess from moving up. The two walls that define the recess are together sufficiently strong to resist the upward deformation of the cover dome that would occur due to elevated pressure in the container. The cover is prevented from deforming, even though the material of the cover is relatively thin, as compared with conventional cover thicknesses designed to resist the same container pressures.

Several embodiments of means for effectively locking the two side walls of the recess to rise outward together are disclosed here, but others could be envisioned by one of skill in this art. For example, during manufacture of the cover, either during the process of forming the countersunk recess or in a subsequent handling process, the side walls of the recess are deformed toward each other to define one or more annular ribs or other projections which extend far enough toward each other as to engage and interfere with and prevent the passage of one rib or deformation on one wall past the rib on the other wall and prevent the movement of one rib on one wall with respect to the rib on the other wall. Upon the ribs of the opposed walls engaging, the radially inner wall is prevented from rising past the radially outer wall, so that they can thereafter only rise together.

The cover may be formed using a die, in a stamping process for example. Either during that initial forming process or usually at a later forming stage, the side walls of the recess are deformed, e.g. by a punch or a pinching clamping element, to define the interfering ribs, projections, etc.

These embodiments of the invention are based on making it difficult for the radially outer wall to change its direction by unfolding upwardly and having the radially inner wall follow it. In effect, these embodiments provide a double thick wall preventing the deformation of the dome. This cover construction is stronger against deformation than previous cover designs. The countersunk recess around the periphery of the dome and radially inward of the periphery of the cover strengthens the cover and dome against deformation and also prevents the cover from bulging up.

An alternate embodiment prevents or inhibits the outer and inner recess walls from rising along with the dome by incorporating means which stiffen at least one of the recess walls and particularly the radially outer wall against deforming. In the preferred embodiment here, the radially outer wall is corrugated, e.g. during formation of the recess, and the corrugations extend along the height of the outer wall down to the bottom of the recess. If the dome tries to rise under internal container pressure, it pulls upon the outer recess wall and thereby on the bottom of the recess. But, the corrugations on the radially outer wall inhibit that wall from deforming so that the bottom of the recess and thus the inner wall do not rise and the dome does not deform. The corrugated arrangement here could be combined with annular ribs or the like on and projecting from the recess walls, as in the earlier described embodiments. The radially outer wall or both the radially inner and outer walls can be corrugated as pressure conditions demand.

The invention is not limited to use with metal covers, nor to any specific thickness cover, nor to any specific type of pressurized container, nor to dispensing any specific fluent materials.

Other objects and features of the present invention will become apparent from the following description of preferred embodiments of the invention, considered in conjunction with the accompanying drawings.

DESCRIPTION OF THE PREFERRED EMBODIMENTS

Figure 1:
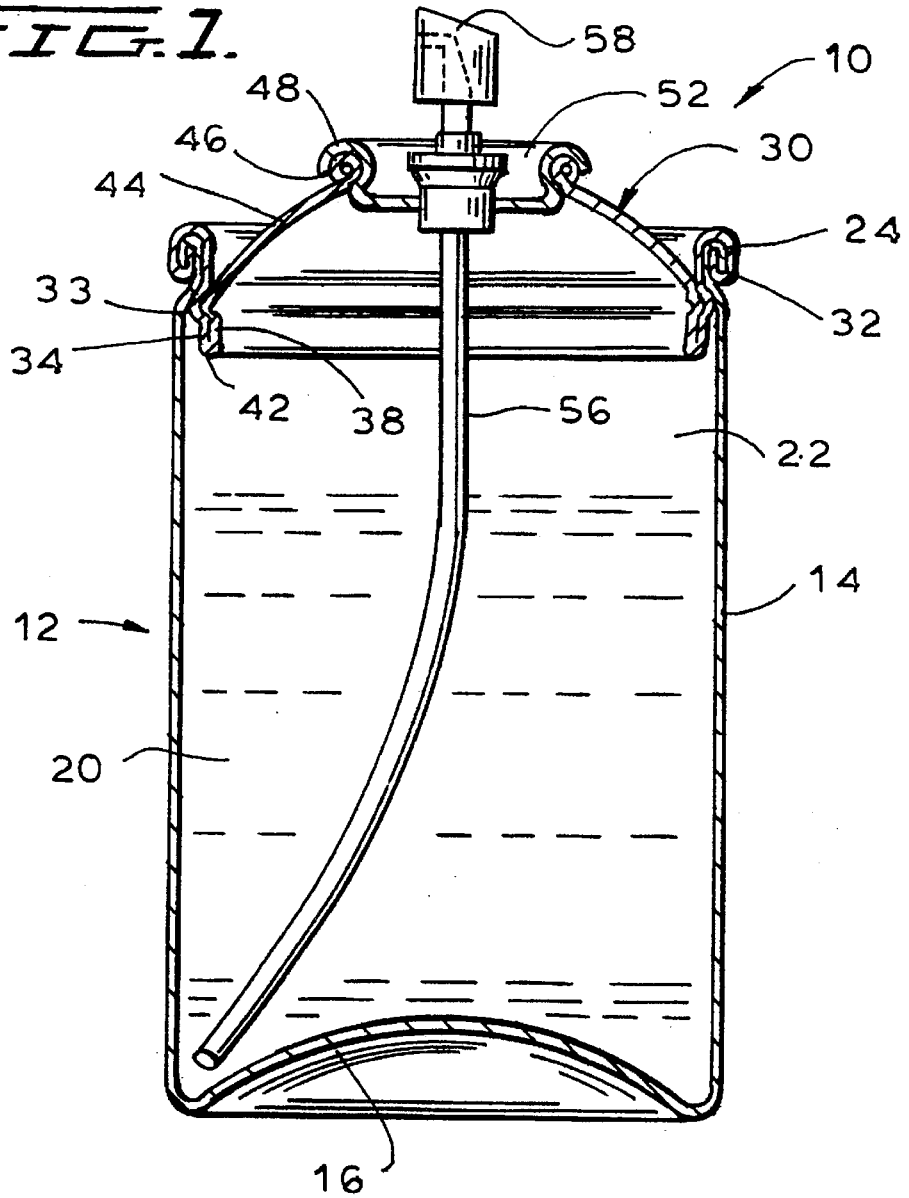
FIG. 1 is a cross sectional view of an aerosol spray container with a cover or lid according to a preferred embodiment of the invention.

FIG. 1, shows an aerosol spray container 10, of the type shown in U.S. Pat. No. 5,211,317, incorporated herein. That container includes a unitary open top can 12 with a cylindrical side wall 14 and an internally or concavely domed bottom 16, which is so shaped as to resist deforming outward due to the internal pressures in the can. The can is filled with mixed gas pressure generating propellant and fluent material contents that are to be dispensed. These contents are mixed in a pool 20, and the space 22 above the pool 20 would be filled with gaseous propellant.

The can side wall 14 has a top edge at 24 which is illustrated as folded over where it is crimped to the periphery of the cover 30 of the invention. Except for the inventive features disclosed herein, the lid or cover 30 is otherwise of conventional design. Its peripheral edge region at 32 is folded over and crimped to the top edge 24 of the can so as to hold the cover firmly to the can and provide a pressurized gas tight seal.

During the process of forming the cover by stamping, an adequately deep countersunk recess 34 is formed radially inward of the peripheral edge region of the cover 30. The recess is formed between the radially outer wall 36 and the radially inner wall 38 which are formed from portions of the cover and those walls have respective opposed, facing sides which together define the side walls of the recess. The walls meet at the closed bottom 42 of the recess.

Radially inward of the inner wall 38 of the recess, the cover has a convex dome 44. The convex shape is selected because it is stiffer against deformation than would be another shape. The radially inner edge of the dome 46 is in turn crimped to the radially outer edge 48 of the nozzle seal and collar 52. The nozzle seal and collar in turn holds the supporting nozzle plug 54. Depending from the plug 54 is the hollow nozzle intake tube 56 which extends to the bottom of the pool 20 of fluent material. The hollow tube 56 extends up through the plug 54 into the spray nozzle 58, which would be of conventional design, for providing an aerosol spray of the contents of the can when the nozzle is actuated by depressing it.

Figure 2:
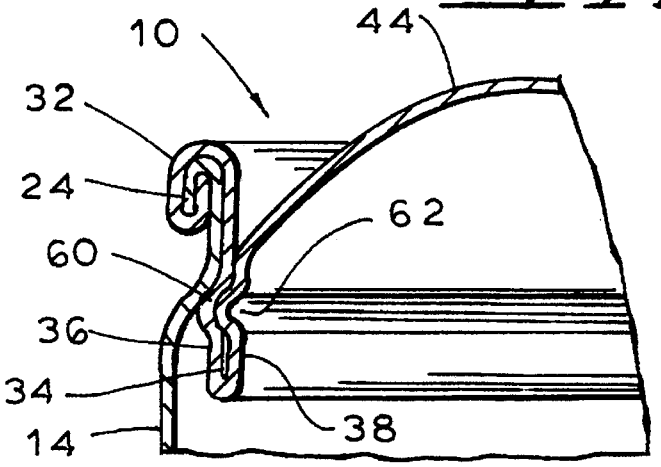
FIG. 2 is an enlargement of the peripheral region of the cover in FIG. 1 showing the means inhibiting deformation of the cover.

The invention concerns means for stiffening the cover 30 against deformation due to elevated pressure in the can. As shown in FIG. 2, the radially outer wall 36 defining the recess 34 in the cover includes a radially outwardly projecting or concave annular recess 60. Correspondingly, the radially inner wall 38 of the recess is provided with a radially outwardly projecting or convex annular rib 62, which projects into recess 60 in the radially outer wall 36. The concave recess 60 and the convex rib 62 are respectively so sized and shaped that there is no play between them for relative vertical motion between the recess walls 36 and 38. When the dome 44 is urged to deform upwardly by pressure in the can 10, the inner recess wall 38 is pulled upwardly with the rising dome, but the projecting rib 62 in the recess 60 interferes with the rib 62 rising and causes both of the walls 36 and 38 to resist the further upward movement of the wall 38. This resists deformation of the dome due to pressure in the container because of the double thickness of the recess walls.

Figure 3:
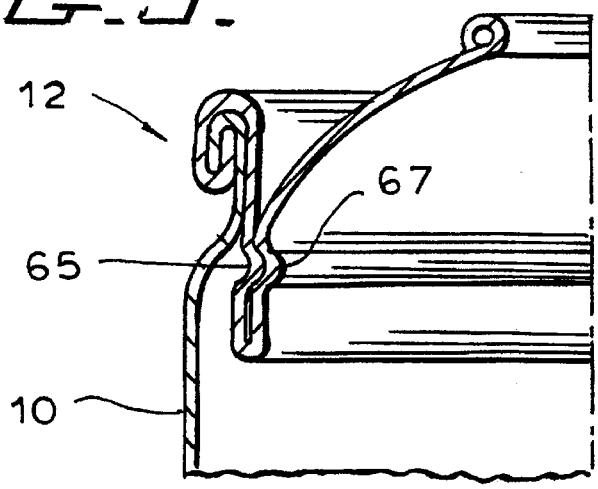
FIGS. 3, 4 and 5 are enlargements of the peripheral region of the cover showing further alternative embodiments of means for inhibiting deformation of the cover.
Figure 4:
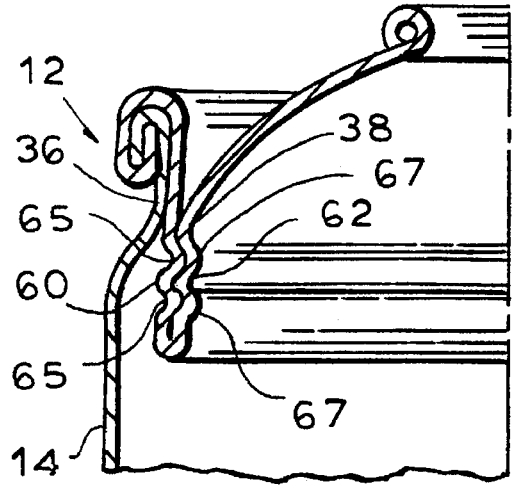
Figure 5:
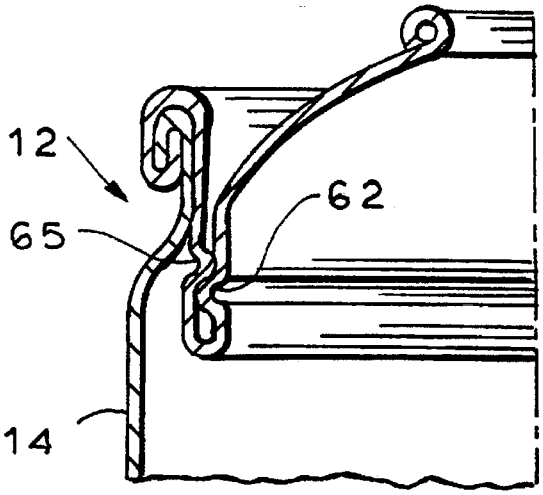

Alternative embodiment of means for preventing or inhibiting deformation of the cover 30 are found in FIGS. 3, 4 and 5. In FIG. 3, a convex annular recess 65 is formed in the outer wall 36, and a concave annular rib 67 is formed in the inner wall 38. Thus in cross-section, the convex recess 65 and the concave rib 67 are the mirror image of the means inhibiting cover deformation shown in FIG. 2.

In FIG. 4, two convex annular recesses 65 are vertically disposed on the outer wall 36, and positioned between them on outer wall 36 is a concave annular recess 60. These configurations on outer wall 36 respectively interlock with two concave annular ribs 67 vertically disposed on either side of a convex annular rib 62 formed on inner wall 38. The interlocking recesses and ribs in FIG. 4 have little play between each other so as to prevent deformation of cover 30 in the event the pressure within the aerosol container 12 is elevated.

FIG. 5, shows a further variation of the cover deformation means of FIGS. 2–4. In FIG. 5., an inwardly projecting, convex annular recess 65 is disposed on outer wall 36. Below, and almost abutting the inwardly projecting convex annular recess 65 is an outwardly projecting convex annular rib 62 formed on the inner wall 38 of recess 34. Thus, if elevated pressure in the aerosol container 10 urges the dome 44 to move upwardly and pulls upwardly on inner wall 38, the convex annular rib 62 in inner wall 38 moves up against the convex annular recess 65 in outer wall 36 which inhibits further upward movement of inner wall 38, and thereby resists deformation of the dome.

Other techniques for locking the radially inner and outer walls together, for causing upraising force applied to the inner wall to be applied also to the radially outer wall of the recess for providing a double thick wall resisting deformation may be apparent to one of skill in the art.

Figure 6:
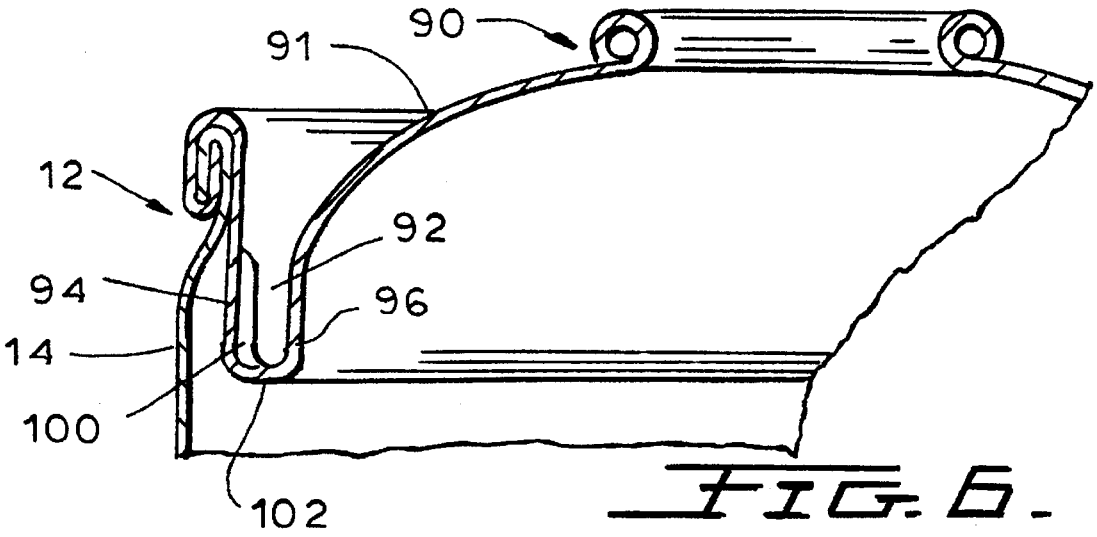
FIG. 6 is a cross sectional view at line 6—6 in FIG. 7 of a fragment of a cover provided with an alternate embodiment of means inhibiting deformation of the cover.
Figure 7:
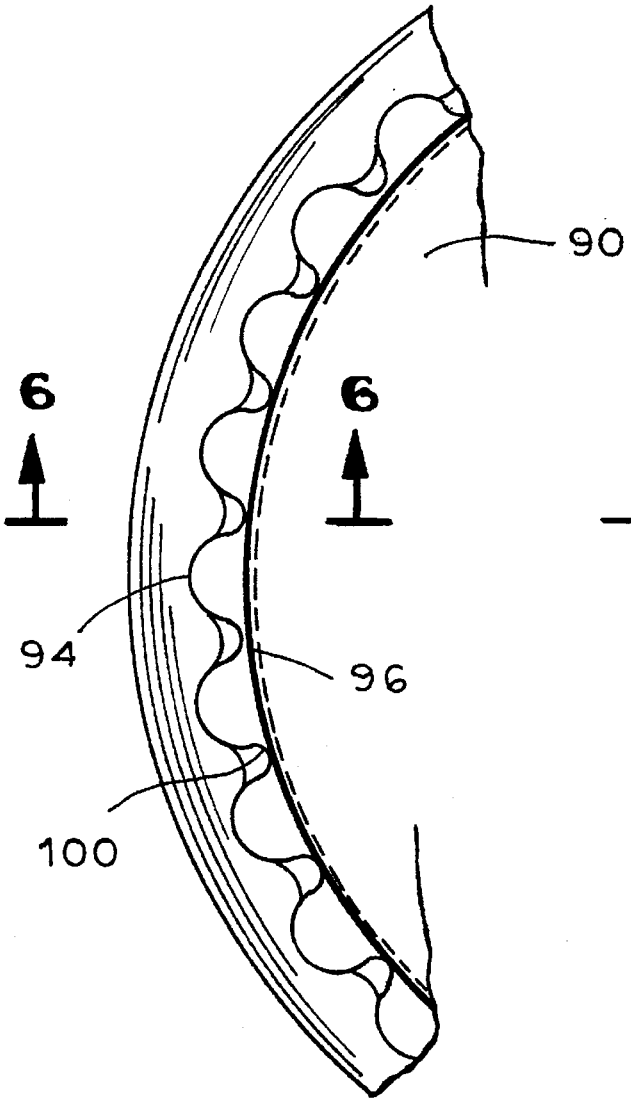
FIG. 7 is a plan view of a fragment of the cover showing the inhibiting means of FIG. 6.

FIGS. 6 and 7 illustrate an alternate way of preventing the dome 91 of the cover 90 from rising under elevated pressure in the container 12. Here the recess 92 in the cover is defined between the opposed, radially spaced apart, radially outer recess wall 94 and radially inner recess wall 96. To prevent the dome 91 from rising, which would pull the inner wall 96 upward, the outer wall 94 is stiffened by a continuous series of vertically, extending corrugations 100 deforming the wall 94 inward and outward as seen in FIG. 5, around the whole wall. The corrugations prevent the wall 94 from bending or deforming and this in turn prevents upward force on the wall 96 from pulling up on the recess floor 102 which would require bending of the outer wall 94. The corrugations 100 greatly stiffen the cover beyond the strength of the mere thickness of the cover material and prevent deformation of the dome with considerably thinner dome and cover material. This embodiment of a stiffer cover and dome does not rely on the double thickness of the two recess walls.

The corrugations may be formed at the time the recess 92 is formed by the same shaping means, or may be formed in a later handling stage during fabrication of the cover or assembly of the container and the cover.

Figure 8:
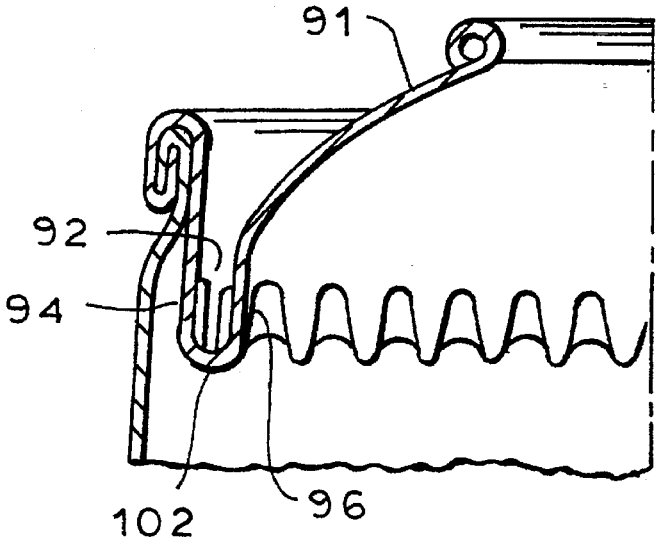
FIGS. 8–10 are enlargements of the peripheral region of the cover showing further alternatives of the deformation inhibiting means of FIGS. 6 and 7.
Figure 9:
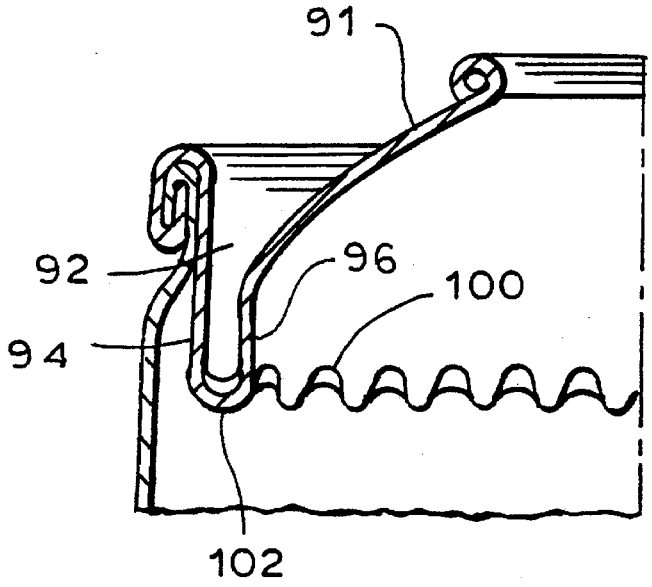
Figure 10:
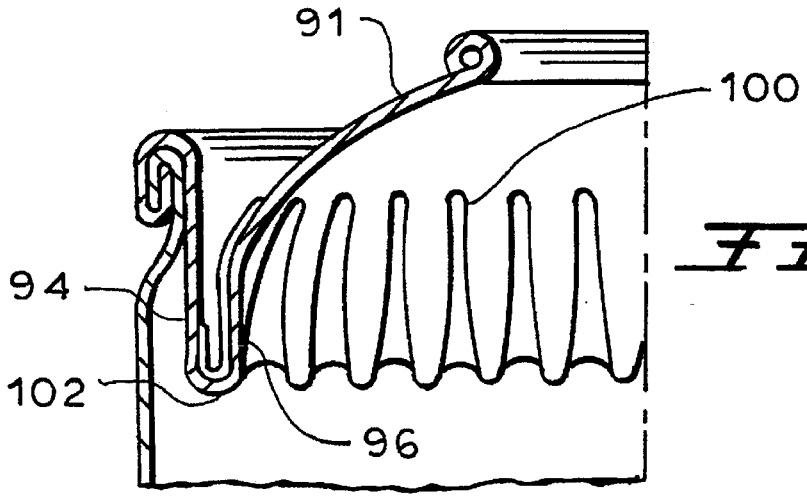

Alternative embodiments of a cover 30 using corrugations 100 to stiffen the thin-walled cover and increase resistance to deformation induced by internal pressure in the aerosol container are shown with reference to FIGS. 8–10. In FIG. 8, the corrugations 100 extend vertically along the outer wall 94 and inner wall 96 of recess 92, as well as along the recess floor 102. A further embodiment of cover 90 utilizing corrugations 100 is shown in FIG. 9 where the corrugations extend only along the recess floor 102 of recess 92. In still a further embodiment as shown in FIG. 10, the corrugations 100 extend vertically along the outer wall 94, along the recess floor 102, and extend vertically from the side wall 96 as well as extending into a portion of the dome 91.

In any configuration of cover 90 where corrugations 100 are used to inhibit dome deformation, sufficient space must be provided in the recess 92 to accommodate the seaming chuck needed for forming the double seam between the cover and container body. Typically, the seaming chuck can be accommodated readily in recess 92 by merely limiting the vertical height to which the corrugations 100 extend within recess 92, thereby leaving sufficient space for the seaming chuck to be positioned within the recess.

Figure 11A:
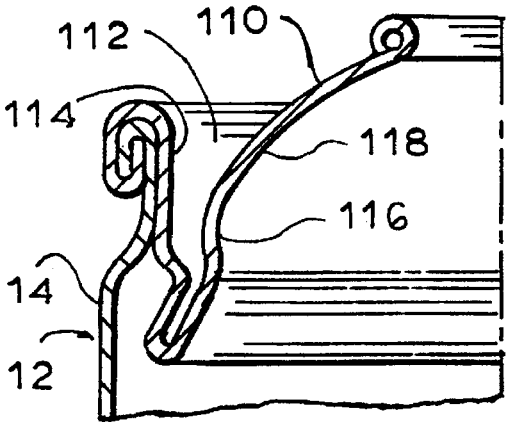
FIGS. 11A and 11B are enlargements of the peripheral region of the cover showing still a further alternative embodiment of a deformation inhibiting means.
Figure 11B:
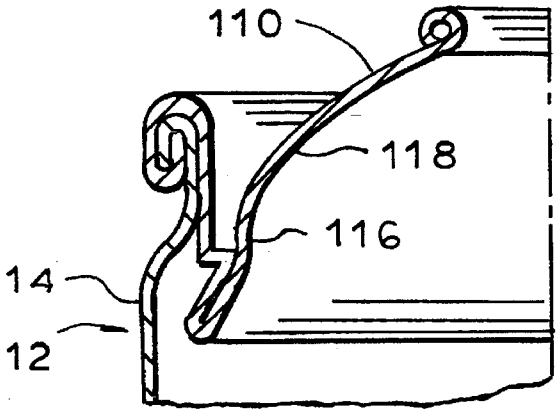

A further alternative by which the inner and outer walls of the countersunk recess cooperate to resist deformation of a cover 110 from deforming due to elevated pressure within the aerosol container 10 is shown in FIGS. 11A and 11B. Referring first to FIG. 11A, a countersunk recess 112 comprises radially outer recess wall 114 spaced apart from a radially inner recess wall 116. While at the upper portion of recess 112 sufficient space is provided to accommodate a seaming chuck between inner and outer walls 114 and 116, the lower portion of recess 112 is bent at a slight outwardly directed angle and the inner and outer walls 114 and 116 are disposed closer together. In the event that the internal pressure of the aerosol container 10 increases, the dome 118 of cover 110 is urged upward which causes the inner wall 116 to also move upward. However, this upward movement of inner wall 116 results in the closing of the gap between the angled lower portion of inner wall 116 and the angled lower portion of outer wall 114. With the gap closed, the lower angled portion of inner wall 116 abuts against the lower angled portion of outer wall 114, thereby inhibiting any further displacement or deformation of the dome 118 because of the resulting double wall thickness at the lower portion of recess 112. The gap between the lower angled portions of inner and outer walls 116 and 114 gauges the onset by which this configuration resists the deformation of dome 118 due to elevated pressures in the container 10.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A cover for placement on a pressurized container which dispenses a fluent material, the cover comprising:

a central dome shaped to project out of the container with the cover in place on an open end of the container;

a peripheral edge of the cover adapted for being attached on the open end of the container;

the cover being shaped to define a recess disposed radially inward of the peripheral edge of the cover and outward of the dome and such that the recess has a bottom that projects into the container with the cover mounted on the container open end; the recess has and is defined by a radially outer wall part of the cover on the side of the recess toward the peripheral edge of the cover and a radially inner wall part of the cover on the side of the recess toward the dome; and means spaced above the bottom of the recess for reinforcing at least one recess wall to resist the application of a force from within the container causing the deformation of the recess, the means comprising a radially disposed projection at the inner and the outer walls.

2. In combination, a container for pressurized fluent material and the cover of claim 1;

the container including a closed bottom, side walls extending up from the bottom and an open top end;

the peripheral edge of the cover being secured to the open top end of the container forming a sealed pressurizable container.

3. The combination of claim 2, wherein the cover is so shaped that the recess is radially near to the peripheral edge of the cover where the edge is attached to the open top end of the container;

a container contents dispensing nozzle and means for extracting pressurized material from a container and passing that material to the nozzle both being supported in the cover and the nozzle being operable by actuation while at the cover.

4. The combination of claim 3, wherein the container wall is of a material sufficiently thin that the container may be distorted under finger pressure when the pressurized contents of the container has been fully dispensed from the container; and the material of the cover and the dome thereof is sufficiently thin as to be distortable under finger pressure when the pressurized contents of the container have been fully dispensed.

5. A cover for placement on a pressurized container which dispenses a fluent material, the cover comprising:

a central dome shaped to project out of the container with the cover in place on an open end of the container;

a peripheral edge of the cover adapted for being attached on the open end of the container;

the cover being shaped to define a recess disposed radially inward of the peripheral edge of the cover and outward of the dome and directed such that the recess has a bottom that projects into the container with the cover mounted on the container open end; the recess has and is defined by a radially outer wall part of the cover on the side of the recess toward the peripheral edge of the cover and a radially inner wall part of the cover on the side of the recess toward the dome;

means spaced above the bottom of the recess for causing the inner wall to be engaged by the outer wall such that upon force being applied under the dome to move the dome outward and thereby move the attached inner wall of the recess outwardly, the means comprising a projection disposed at the radially inner wall and the outer wall of the recess so that they cooperate to provide a two wall resistance to the movement of the dome outward.

6. The pressurized container cover of claim 5, wherein the projection at the radially inner wall and the projection at the outer wall of the recess adapted to engage each other in the recess so that movement outward of the dome and the inner wall is resisted by both of the inner and outer walls which are in engagement, by providing a two wall thick resistance to deformation.

7. The pressurized container cover of claim 5, wherein the projections include a first projection located circumferentially around at least one of the inner and the outer walls, and a cooperating projection located circumferentially around the other of the inner and the outer walls extends into the first projection.

8. The pressurized container of claim 5, wherein the means spaced above the bottom of the recess prevents any play in movement between the inner and the outer walls.

9. The pressurized container cover of claim 5, wherein the projections are a radially outward projection at the radially inner wall and a radially outward projection at the radially outer wall which are adapted to engage each other such that the engagement causes the inner and the outer walls to resist movement outward of the dome.

10. The pressurized container cover of claim 5, wherein the projections are radially outer projections at the inner and the outer walls adapted for engaging each other such that the engagement causes the inner and the outer walls to resist movement outward of the dome.

11. The pressurized container cover of claim 5, further comprising a container contents dispensing nozzle and means for extracting pressurized material from a container and passing that material to the nozzle both being supported in the cover and the nozzle being operable by actuation while at the cover.

12. The pressurized container cover of claim 11, wherein the dome has an upraised central portion with an opening through the central portion and the dispensing nozzle is disposed at and is shaped for closing the opening.

13. In combination, a container for pressurized fluent material and the cover of claim 5;

the container including a closed bottom, side walls extending up from the bottom and an open top end;

the peripheral edge of the cover being secured to the open top end of the container forming a sealed pressurizable container.

14. The combination of claim 13, wherein the cover is so shaped that the recess is radially near to the peripheral edge of the cover where the edge is attached to the open top end of the container.

15. The combination of claim 14, wherein the dome has an upraised central portion with an opening through the central portion and the dispensing nozzle is disposed and is shaped for closing the opening.

16. The combination of claim 14, further comprising a container contents dispensing nozzle and means for extracting pressurized material from a container and passing that material to the nozzle both being supported in the cover and the nozzle being operable by actuation while at the cover.

17. The combination of claim 16, wherein the container wall is of a material sufficiently thin that the container may be distorted under finger pressure when the pressurized contents of the container has been fully dispensed from the container.

18. The combination of claim 17, wherein the material of the cover and the dome thereof is sufficiently thin as to be distortable under finger pressure when the pressurized contents of the container have been fully dispensed.

19. The combination of claim 16, wherein the nozzle is adapted for dispensing an aerosol spray and the container is an aerosol spray container adapted for containing both a dispensable fluent material and a pressure generating propellant.

20. The pressurized container cover of claim 2, wherein the projections are a first projection disposed at either the inner or outer wall, and a second projection disposed at the other of the inner or outer wall, the first and second projections in opposite radial directions.

21. The pressurized container cover of claim 20, wherein the first and second projections abut each other.

22. A cover for placement on a pressurized container which dispenses a fluent material, the cover comprising:

a central dome shaped to project out of the container with the cover in place on an open end of the container;

a peripheral edge of the cover adapted for being attached on the open end of the container;

the cover being shaped to define a recess disposed radially inward of the peripheral edge of the cover and outward of the dome and directed such that the recess has a bottom that projects into the container with the cover mounted on the container open end; the recess has and is defined by a radially outer wall part of the cover on the side of the recess toward the peripheral edge of the cover and a radially inner wall part of the cover on the side of the recess toward the dome; and a radially disposed projection spaced above the bottom of the recess at the radially outer wall and at the radially inner wall and capable of engaging each other for reinforcing at least one recess wall to resist the application of a force from within the container causing the deformation of the recess.

* * * * *